United States Patent [19]

Sump

[11] 4,115,311

[45] Sep. 19, 1978

[54] NUCLEAR WASTE STORAGE CONTAINER WITH METAL MATRIX

[75] Inventor: Kenneth R. Sump, Kennewick, Wash.

[73] Assignee: The United States of America as represented by the United States Department of Energy, Washington, D.C.

[21] Appl. No.: 776,383

[22] Filed: Mar. 10, 1977

[51] Int. Cl.[2] ..... G21F 9/34
[52] U.S. Cl. ..... 252/301.1 W; 75/206
[58] Field of Search ..... 252/301.1 W; 264/0.5; 75/206

[56] References Cited

U.S. PATENT DOCUMENTS

| | | | |
|---|---|---|---|
| 3,276,867 | 10/1966 | Brite et al. | 75/206 |
| 3,579,390 | 5/1971 | Paine | 264/0.5 |
| 3,609,095 | 9/1971 | Wyatt | 264/0.5 |
| 3,712,809 | 1/1973 | Bumm et al. | 264/0.5 |
| 3,878,285 | 4/1975 | Kasberg | 264/0.5 |
| 3,993,579 | 11/1976 | Bunnell et al. | 252/301.1 W |

*Primary Examiner*—Benjamin R. Padgett
*Assistant Examiner*—Deborah L. Kyle
*Attorney, Agent, or Firm*—Dean E. Carlson; Richard E. Constant; Ignacio Resendez

[57] ABSTRACT

The invention relates to a storage container for high-level waste having a metal matrix for the high-level waste, thereby providing greater impact strength for the waste container and increasing heat transfer properties.

8 Claims, 1 Drawing Figure

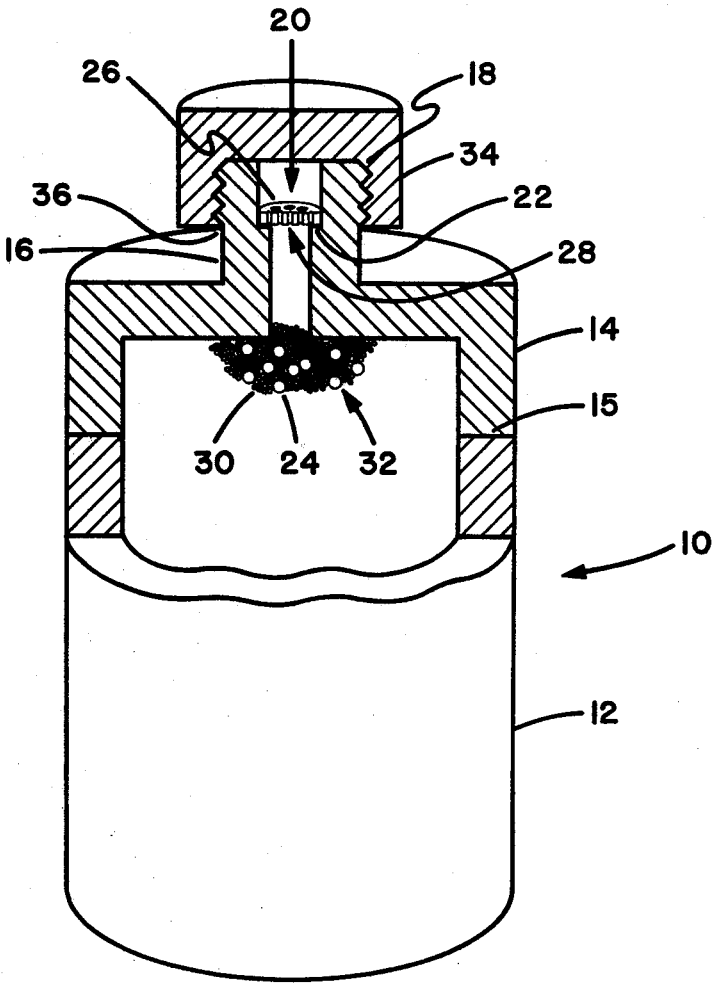
20
26
18
34
36
22
16
28
14
15
30
24
32
10
12

NUCLEAR WASTE STORAGE CONTAINER WITH METAL MATRIX

BACKGROUND OF THE INVENTION

This invention was made in the course of, or under, a contract with the Energy Research and Development Administration.

The invention relates to a storage container containing a gravity sintered metal matrix for high-level radioactive waste.

Nuclear waste storage containers containing a metal matrix for the nuclear waste are desired to provide greater impact strength for the waste container and to increase the thermalconductivity to prevent undesirably high centerline temperatures. Matrix fabrication has been effected by casting, although this process may prohibit the use of materials having high melting points which may be required to prevent melting of the matrix during storage from unforeseen temperature excursions or other accidents. Matrix fabrication by prior processes has generally been concerned with low temperature metals such as lead and aluminum.

Present waste encapsulation technology includes the use of waste containers of such lengths as 15 feet and of from 1 to 2 feet in diameter. High-level waste particulate material to be stored in these containers may be only about 1 millimeter (mm) in diameter. In order to provide a matrix around these materials of such small particulate size, a very fluid metal, under perhaps considerable pressure, would be required to fully penetrate a large volume, such as a storage container, of small particles. The degree of difficulty in providing a cast matrix increases at a fast rate as the waste particulate material size decreases.

In addition to this drawback to casting, other drawbacks include the requirement for heated pipes or other heating elements to transport liquid metal into and around the cells in which the high-level waste is maintained, or the melting of large quantities of metals inside the cell in which the high-level waste is retained, with the associated problems of remote operation from the cell exterior to the cell interior.

Other pressing and forming type processes such as extrusion, mechanical or hydraulic pressing, swaging, high energy rate forming, etc., extensively complicate the container fabrication process, especially when required to be performed within a hot cell, and the use of this type of process to assemble several smaller units to form the large storage container would result in a loss of overall capacity. In addition, it is desirable to retain the size, shape, and integrity of the high-level nuclear waste particles, and, in some cases, to provide a protective cladding to these particles. The use of the pressing and forming processes described hereinabove would cause a degradation of these properties of the particles and of the cladding.

SUMMARY OF INVENTION

In view of the above limitations and goals, it is an object of this invention to provide a process for forming a sintered metal matrix for high-level waste particles within a large storage container.

It is a further object of this invention to provide a storage container containing high-level nuclear waste in a sintered metal matrix, which metal matrix provides impact strength to the waste container and increases heat transfer from the container interior to the container exterior to prevent undesirably high centerline temperatures within the container.

It is a further object of this invention to provide a process for forming said storage containing high-level waste in a sintered metal matrix wherein the high-level waste particles and cladding are not degraded in the matrix formation process.

It is a further object of this invention to provide a storage container containing high-level wastes in a metal matrix, wherein the matrix materials are high temperature resistant materials, such as greater than about 750° C. to about 1500° C.

Various other objects and advantages will appear from the following description of this invention and the most novel features will be particularly pointed out hereinafter in connection with the appended claims. It will be understood that various changes in the details, materials, and layout of the apparatus and process which are herein described and illustrated in order to explain the nature of the invention may be effected by those skilled in the art without departing from the scope of this invention.

The invention comprises a method for forming, and the product formed thereby, a storage container having a high-level waste disposed in a sintered metal matrix, comprising disposing a high-level waste into a storage container, thereafter disposing a metal powder into the container with the high-level waste, hermetically closing the port through which the high-level waste and metal matrix were fed into the container, and thereafter heating the hermetically sealed container containing the high-level waste in the metal matrix to a sintering temperature to form a sintered metal matrix containing the high-level waste in the storage container.

DESCRIPTION OF THE DRAWING

The drawing is a partially cross-sectional, perspective view of a storage container having high-level waste in a sintered metal matrix.

DETAILED DESCRIPTION

As shown in the drawing, the storage container 10 comprises an elongated, generally cylindrical, lower portion 12 and an upper portion 14 suitably joined to lower portion 12 such as by welded joint 15. A neck or projecting tubular member 16 extends from upper container portion 14 and has a threaded end 18. Tubular member 16 has a passageway or opening 20 therethrough extending into storage container 10. The inner wall of tubular member 16 contains a lip or ledge 22 which divides passageway 20 into a larger diameter portion and a smaller diameter portion as shown in the drawing. This container may be made of any suitable material such as AISI 304 Series stainless steel having properties such as heat resistance, resistance to degradation upon exposure to the environment, thermostability, and the like. A mild steel having a protective coating may likewise be used for the container which is used for containment of the matrix powder with the high level waste particles. Various storage containers have been previously used for containing high-level wastes in cast matrices.

In forming the product of this invention, a high-level waste 24 is initially fed into the storage container 10 in the form of particles or the like wherein the high-level waste particulate material has a diameter of from about 0.5 to about 25 mm. The highlevel waste particles 24 may be in the form of clad or unclad particles, as known in the waste disposal part.

Storage container 10 may be up to about 15 feet long and have an inner diameter of up to about 2 feet. In the drawing, the size of the particles has been exaggerated in order to facilitate a comprehension of the invention and also to facilitate an illustration of the novel features of the invention.

After the high-level waste particles are disposed within the storage container 10, a screen 26 or other retaining element having perforations or apertures 28 of a size smaller than the size of the high-level waste particles, may be disposed above the high-level waste particles, the screen 26 resting on lip 22 of tubular member 16 to retain the particles in the storage container without loss to the outer environment. The size of the perforations or openings 28 is generally dependent upon the size of the high-level waste particles. It may be desirable to use an opening size as large as possible without defeating the purpose of the screen to permit a maximum amount of matrix powder 30 to be passed through the screen openings 28 in a minimum amount of time to form the matrix for the high-level waste particles 24.

The metal matrix powder 30 having a size of from about 0.05 to about 2 mm, and preferably having a diameter of one-sixth or less than that of the high-level waste particles, is then passed into storage container 10 through the screen or element 26 and interspersed with the high-level waste particles 24. Although the range called out is from 0.05 mm to about 2 mm, it is understood to one skilled in the art that it would be preferred to include smaller size powder together with 2 mm powder in order to best fill in the voids between the waste particles. For clarity of illustration, only a portion of the particles 24 and powder 30 is illustrated in the drawing. It will be understood that the remainder of the storage container's space under screen 26 is filled with these particles and powder. A cover member 34 is then placed over the passageway 20, through which the high-level waste material and the element 26 as well as the metal matrix powder were fed into the storage container 10. Cover member 34 may have an inner threaded portion 36 for threaded engagement with threaded end 18 of tubular member 16. Cover member 34 may subsequently be bonded to the storage container 10 by a suitable process which provides a suitable hermetic bond of the cover to the storage container 10. For example, the cover 34 may be welded to the container 10 such as by resistance or tungsten inert gas welding.

The small diameter size of the metal matrix powder, which is generally 1/6th or less the size of the high-level waste powders, will filter down and intersperse throughout the volume of storage container 10 to form an aggregation or composite 32 of high level waste particles in a metal powder matrix. It may be desirable, depending on the size and shape of the waste and matrix particles, to vibrate the container as the metal powder is fed into the container to obtain the desired matrix density such as by using a base-type vibrator. If the metal matrix powder is spherical, the advantage of vibration is reduced. The waste particles can occupy up to 50 to 70 volume percent of the container, and the relative particle size and shape of the high-level waste particles will also cause the metal powder matrix density to vary from 35 to 65 percent of theoretical of the remaining volume. The void volume in the matrix is an additional asset and provides a desired result since this eliminates the need of leaving a space at the top of the container for any possible gas pressure caused by isotope decay and/or thermal outgassing.

Sintering of the metal powder may be done in a furnace at a temperature below the melting point of the matrix and below the previous fabrication temperature of the high-level waste particles. It is desirable to stay within the previously used fabrication temperature of the high-level waste particles to not adversely affect the physical properties of the particles or the cladding, which may be such as a coating of aluminum oxide over pyrolytic carbon on the particles. As an example, waste particles fabricated at 950° C. and contained, embedded or enclosed in a copper matrix material could subsequently be gravity sintered at 700° C. to 950° C. Selection of the time, temperature and the like yields little or no shrinkage during gravity sintering. Employing gravity sintering, with or without vibration, consolidates the particles and matrix during heating and yields a sintered or diffusion bond at matrix contact points. The matrix 32 stays in contact with the container wall and the individual matrix particles bond at their contact points and form a load bearing structure and a good thermalconductivity path. For example, a 53% theoretical density 316 stainless steel cylindrical sample (without waste particles), initially $1\frac{3}{4}$ inch long and $\frac{7}{8}$ inch diameter, sustained a maximum load of 59,600 pounds and a 60% height reduction before failure. Since there is no pressure exerted upon the high-level waste particles during matrix fabrication, no degradation of the high-level waste particles, or if clad, of the cladding occurs.

Depending upon the materials involved, a stagnant cell atmosphere may be left in the can prior to gravity sintering, or the vessel storage container may be evacuated to a rough static vacuum of 50 microns, and thereafter sintered in the evacuated condition, or a dynamic vacuum may be applied during the sintering step which would have the added benefit of any outgas removal, or the chamber or storage container, after evacuation, may be backfilled with an inert gas such as helium or argon, to one atmosphere or less pressure prior to gravity sintering. Use of vacuum or inert gas improves the sintering process and may improve the subsequent mechanical properties of the materials because of a cleaner bond area between particles.

It should be noted that while the ease of providing a matrix for waste particles increases with the increased size of the particles, the present invention much more easily provides a matrix for small size waste particles, even as low as 0.5 mm in size, than prior art casting procedures.

There are several advantages to this process and the product of this process, including an economic advantage over cast matrix processes, because of less material and equipment required, a product that has superior thermal conductivity properties compared to solid glass or ceramic waste, and a product wherein the matrix provides strength. A further advantage in high level waste applications is that the matrix powders do not bond to the particles such that, if there is an accidental fracture, the particles themselves are not fractured but the matrix breaks around the particles, fines generated from fractured particles may become airborne or transported rapidly by other means.

The high-level waste particles that may be used in this invention may be obtained from glass particle fabrication processes or ceramic particle fabrication processes wherein the waste form utilizes existing calcining processes with a compositionally modified waste liquid to achieve an improved or supercalcine waste form in which generally all of the radioactive atoms will be isolated in thermally and chemically stable phases. For example, the high level waste particles may be chemical vapor deposition alumina and pyrolytic carbon coated improved ceramic particles or supercalcine ceramic particles, and generally contain fission products as ceramic oxides or as glass modifiers. The metal matrix powders that may be used are such as pure copper and its alloys, pure iron and its alloys, AISI Series 410, 304, 310 and 316 stainless steels, and superalloys, such as Inconel or Hastalloy. A particularly good copper alloy matrix is manganese bronze having a nominal composition, expressed in weight percent, of 57.5 copper, 39.25 zinc, 1.25 iron, 1.25 aluminum, and 0.25 manganese. The properties of the matrix materials that are desirable are a high melting point, good thermoconductivity, good mechanical strength, good corrosion characteristics in salt, water, and/or air, and good oxidation resistance in air at operating temperatures.

What we claim is:

1. A method of encapsulating a high-level radioactive waste within a metal powder matrix in a storage container having a maximum length of about 15 ft. and maximum inner diameter of about 2 ft. wherein said matrix is not formed by molten metal, consisting essentially of disposing high-level radioactive waste particles within said storage container, said high-level waste particles having a diameter of from about 0.5 to about 25 mm, interspersing a metal powder having a particle size of from about 0.05 to 2.0 mm into said waste to permeate between and around said high-level waste particles, disposing a cover member on said storage chamber to close and seal said storage chamber, and heating said storage chamber containing said metal matrix powder and said high-level waste particulate material to a sintering temperature for a sufficient length of time to sinter said metal powder and effect a metal powder matrix about said high-level waste particles, said high-level waste particles occupying from about 50 to about 70 volume percent of said storage container and said metal powder matrix occupying from about 35 to about 65 volume percent of theoretical of the remaining volume of said storage container, said metal powder matrix providing impact strength to said storage container and increasing heat transfer from said storage container interior to said storage container exterior to prevent undesirably high center line temperatures.

2. The method of claim 1 wherein said high-level waste particles are about 1 millimeter in diameter.

3. The method of claim 1 wherein said metal powder is of the size of about 0.1 millimeters.

4. The method of claim 1 wherein said high-level waste particles are about six times as large as said metal powder particles.

5. The method of claim 1 wherein said high-level waste particles are chemical vapor deposition alumina and pyrolytic carbon coated supercalcine ceramic particles and said metal powders are selected from the group consisting of copper, iron, copper alloys, iron alloys, stainless steels, and heat and corrosion resistant materials.

6. The method of claim 5 wherein said high-level waste particles are of a diameter of about 1.5 mm, said metal powder is AISI 410 series stainless steel, said metal power is of a size of about 0.05 mm, and said sintering is for about 8 hours at about 1050° C.

7. The product formed by the process of claim 6.

8. The product formed by the process of claim 1.

* * * * *